US007606510B2

(12) United States Patent
Kamimura

(10) Patent No.: US 7,606,510 B2
(45) Date of Patent: Oct. 20, 2009

(54) IMAGE FORMING DEVICE INCLUDING A CLEANING DEVICE

(75) Inventor: Naoya Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 479 days.

(21) Appl. No.: 11/391,252

(22) Filed: Mar. 29, 2006

(65) Prior Publication Data

US 2006/0222401 A1 Oct. 5, 2006

(30) Foreign Application Priority Data

Mar. 29, 2005 (JP) ..... 2005-095355

(51) Int. Cl.
*G03G 15/16* (2006.01)

(52) U.S. Cl. ..... 399/101; 399/297

(58) Field of Classification Search ..... 399/101, 399/121, 297, 343, 357
See application file for complete search history.

(56) References Cited

U.S. PATENT DOCUMENTS

| | | | | |
|---|---|---|---|---|
| 4,949,133 | A | 8/1990 | Landa | |
| 6,185,396 | B1 * | 2/2001 | Aizawa et al. | 399/121 |
| 6,507,724 | B2 * | 1/2003 | Tamura et al. | 399/297 |
| 6,941,086 | B2 * | 9/2005 | Kikuchi | 399/101 X |
| 7,127,201 | B2 * | 10/2006 | Takenouchi et al. | 399/297 |
| 7,233,755 | B2 * | 6/2007 | Tango et al. | 399/343 X |

FOREIGN PATENT DOCUMENTS

| | | |
|---|---|---|
| JP | 9-230759 | 9/1997 |
| JP | 10-133532 | 5/1998 |
| JP | 2001-056612 | 2/2001 |
| JP | 2002-055528 | 2/2002 |

* cited by examiner

*Primary Examiner*—Sandra L Brase
(74) *Attorney, Agent, or Firm*—Banner & Witcoff Ltd

(57) ABSTRACT

A laser printer is provided which includes a conveying belt, which is configured for circulating movement and which indirectly supports developer over a recording medium. Furthermore, a cleaning roller which contacts the outer surface of the conveying belt and an opposing roller which faces the cleaning roller are provided. The opposing roller is arranged opposite the cleaning roller across the conveying belt, holding the belt between itself and the cleaning roller. The opposing roller is configured to rotate so as to impart motive force to the conveying belt.

19 Claims, 6 Drawing Sheets

IMAGE FORMING DEVICE INCLUDING A CLEANING DEVICE

CROSS-REFERENCE TO RELATED APPLICATIONS

This application claims priority from Japanese Patent Application No. 2005-95355 filed Mar. 29, 2005, the entire content of which is incorporated herein by reference.

TECHNICAL FIELD

Aspects of the present invention relate to an image forming device.

BACKGROUND

An image forming device including a cleaning device for removing foreign matter (e.g. developer) from the belt has been proposed. For example, in the image forming device of Japanese Unexamined Patent Application Publication 2001-56612, a belt (dielectric belt 1) is circulated around a pair of rollers, one of which functions as a drive roller, which receives motive force and rotates, causing the belt to rotate in one direction. A cleaning member is provided which contacts the outer surface of this belt and allows cleaning of the belt to be performed by causing the cleaning member to act as a load against the movement of the belt.

If one attempts to remove foreign matter by bringing a cleaning member into contact as a load on the belt, as in Japanese Unexamined Patent Application Publication 2001-56612, the contact load generates a force against the belt in the direction opposite to the direction of travel. This force causes slack to form in the belt. If slack is formed in the belt in this manner, defects such as racing of the drive roller may occur.

SUMMARY

Aspects of the invention provide an arrangement that is capable of effectively preventing belt slack due to the contact load of the cleaning element while cleaning the belt by the cleaning element, and allowing stable belt driving to be implemented.

DETAILED DESCRIPTION

Illustrative Aspects

Figure 1:
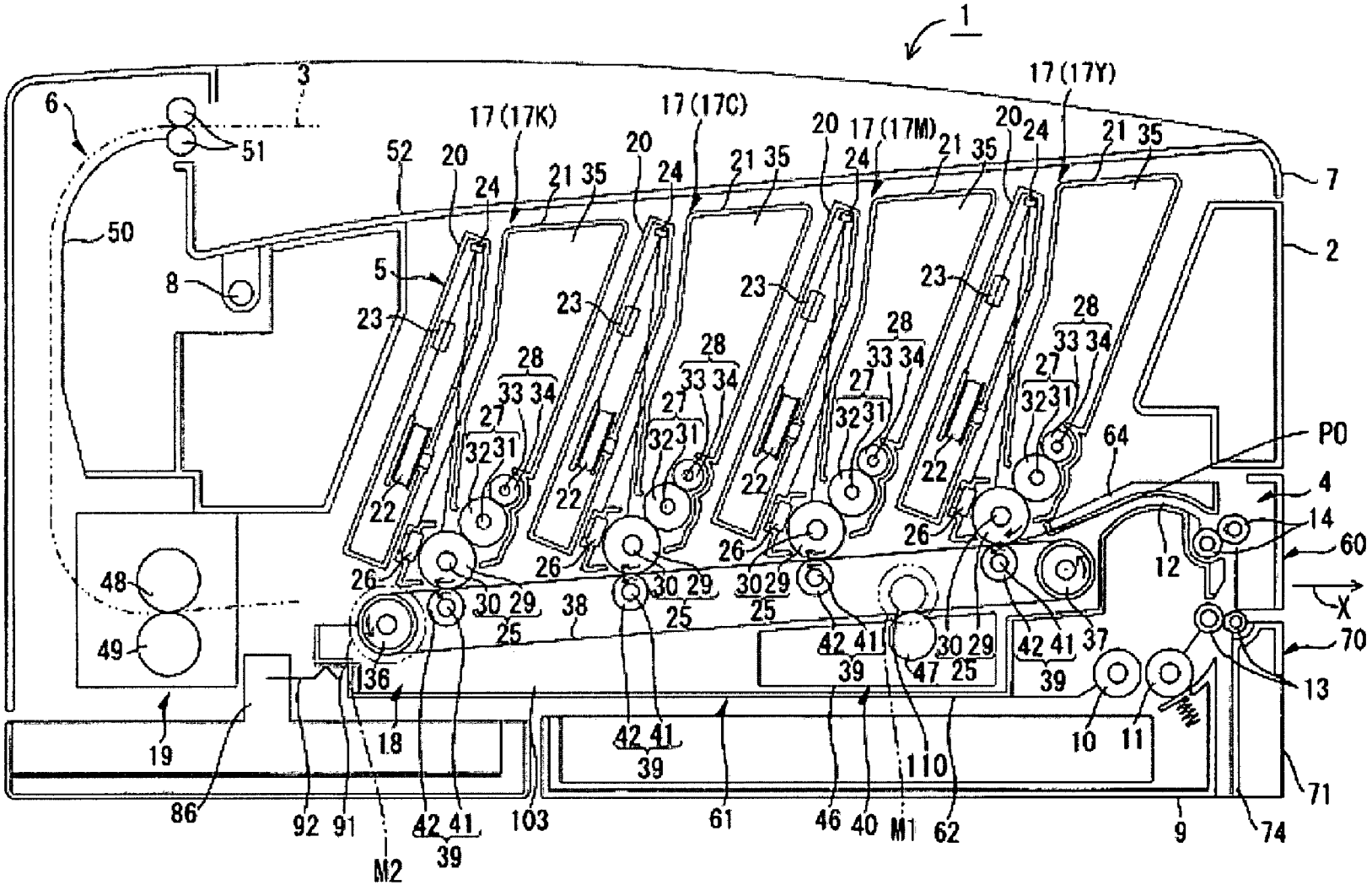
FIG. 1 shows a lateral cross-section schematically illustrating a color laser printer as the image forming device according to at least one aspect of the present invention.
Figure 2:
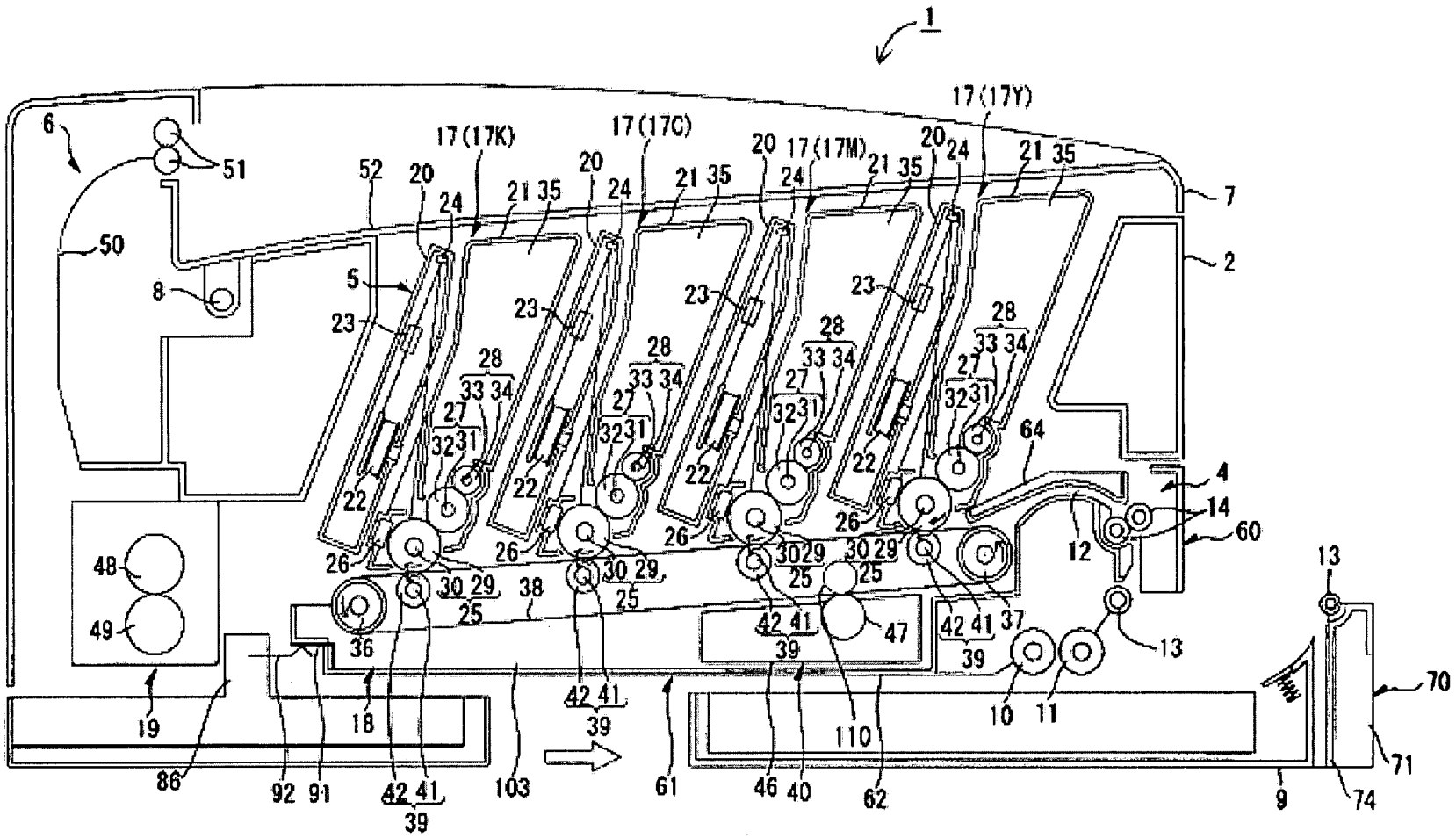
FIG. 2 shows a lateral cross-section illustrating the state of the color laser printer shown in FIG. 1 with the paper feed unit pulled out according to at least one aspect of the invention.
Figure 3:
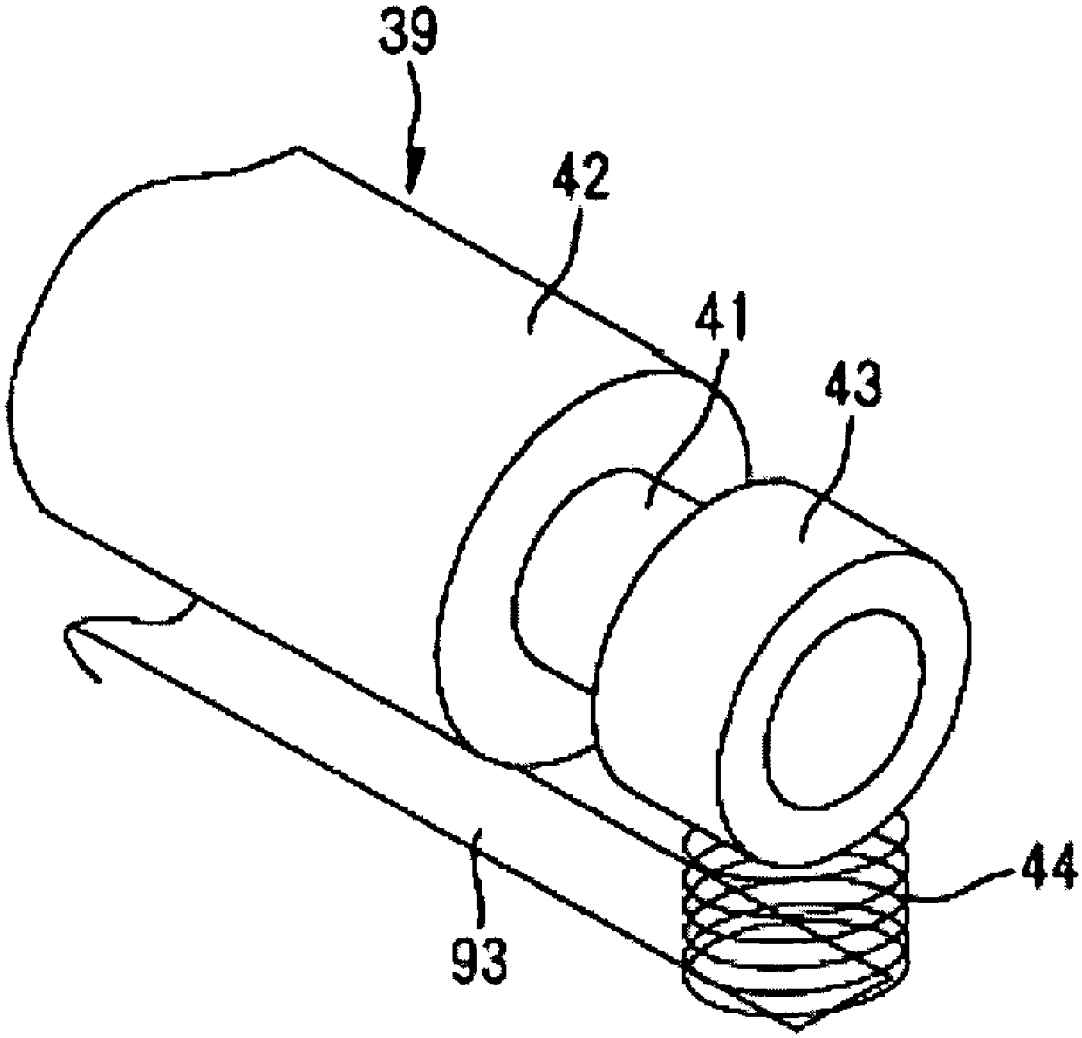
FIG. 3 shows a perspective view schematically illustrating the vicinity of the shaft end of a transfer roller according to at least one aspect of the invention.
Figure 4:
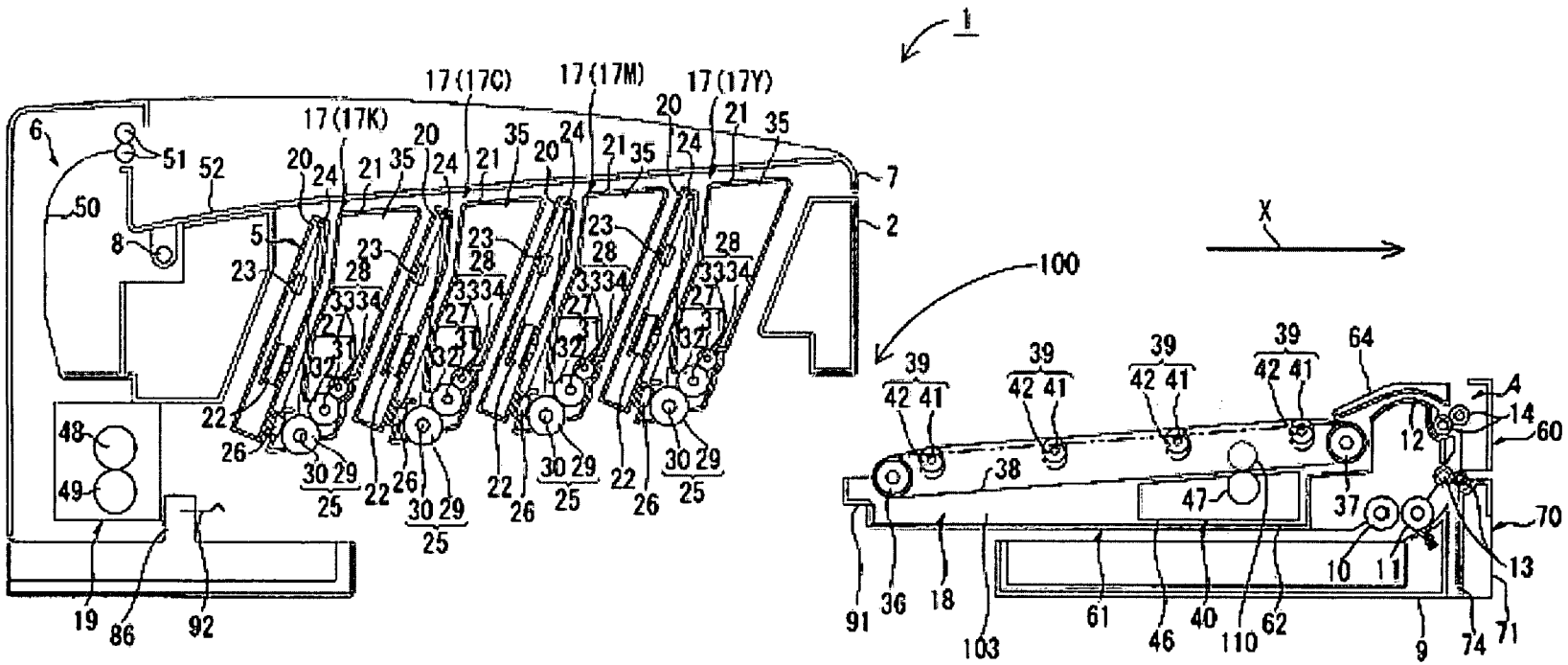
FIG. 4 shows a lateral cross-section illustrating the state of the color laser printer shown in FIG. 1 when the paper feed unit and the belt unit are pulled out according to at least one aspect of the invention.
Figure 5:
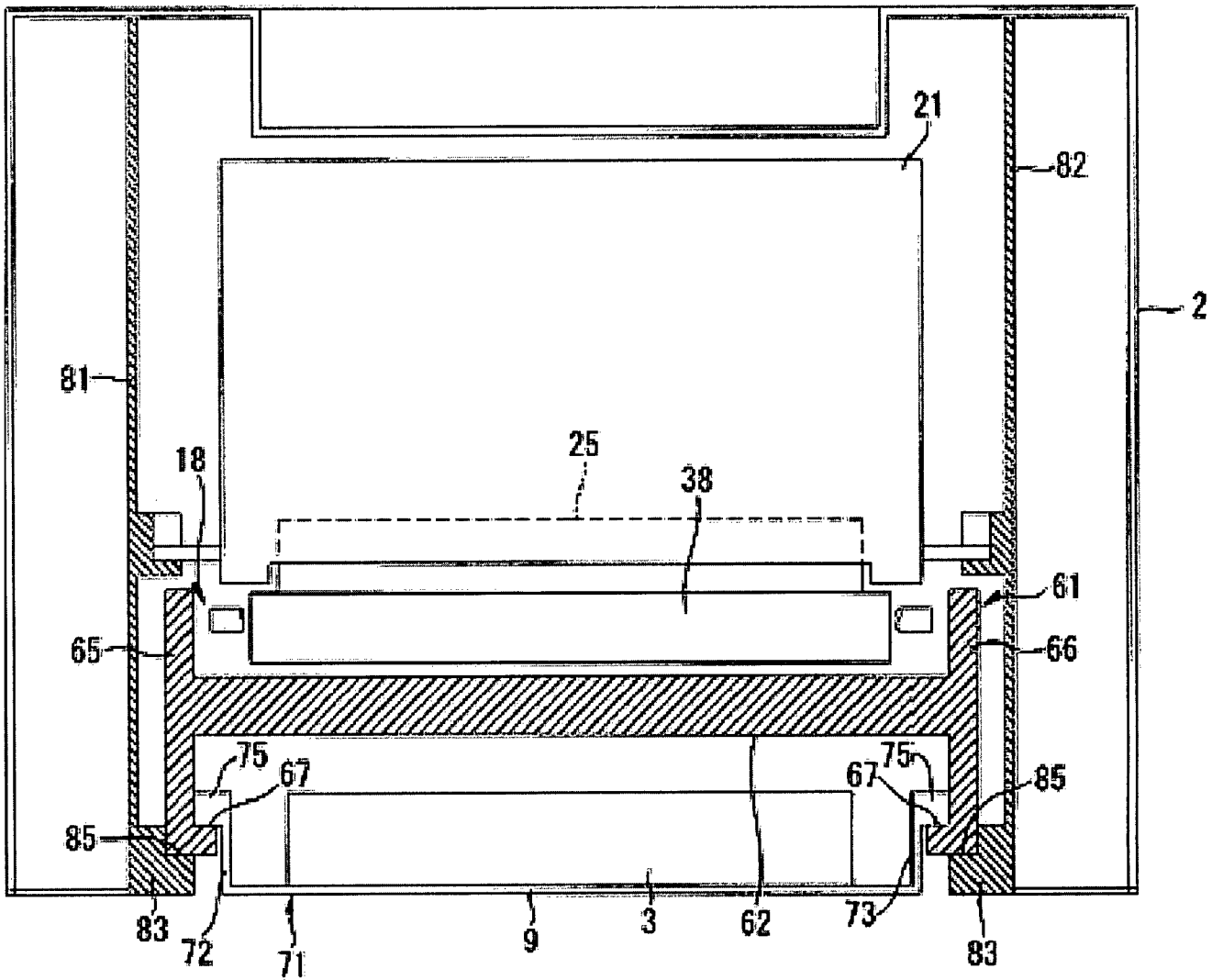
FIG. 5 shows a simplified cross-section schematically illustrating the frontal cross-section of the color laser printer shown in FIG. 1 according to at least one aspect of the invention.

FIG. 1 is a lateral cross-section illustrating a color laser printer as the image forming device according to at least one aspect of the present invention. FIG. 2 illustrates the state of the image forming device of FIG. 1 when the paper feed unit 70 is pulled out. FIG. 3 is a drawing conceptually illustrating the arrangement of bearings. FIG. 4 is a drawing illustrating the state where the belt unit 60 and paper feed unit 70 are both pulled out. FIG. 5 is a frontal cross-section of the color laser printer shown in FIG. 1.

This color laser printer 1 is a side-by-side type tandem color laser printer, in which process units 17 are arranged in parallel horizontally. In the main body casing 2 of the color laser printer 1 there is provided a paper feed unit 4 for feeding paper 3 as a recording medium, an image forming unit 5 for forming images on the fed paper 3, and an ejection unit 6 for ejecting the paper 3 on which an image has been formed.

The main body casing 2 has a substantially rectangular box shape when viewed from the side, with an opening top, and is provided with a top cover 7 at the top side. This top cover 7 is rotatably supported on a cover shaft 8 provided at the rear of the main body casing 2 (in the following description, the left side of FIG. 1 will be referred to as the rear and the right side as the front), and is arranged to freely open and close in relation to the main body casing 2.

The paper feed unit 4 includes a paper tray 9 arranged at the bottom of the main body casing 2, a pick-up roller 10 and paper feed roller 111 provided to the front of and above the paper tray 9 as the feeding means, a paper feed side U-shaped path 12 provided to the front of and above the paper feed roller 11, and a pair of conveying rollers 13 and a pair of registration rollers 14, arranged midway in the paper feed side U-shaped path 12.

The paper tray 9, as shown in FIG. 2, is made such that it can be pulled out, and paper 3 is stacked inside the paper tray 9. The uppermost piece of paper 3 is first picked up by the pick up roller 10 and conveyed forward, after which it is fed by the paper feed roller 11 into the paper feed side U-shaped path 12.

The paper feed side U-shaped path 12 is formed as a substantially U-shaped conveyance path for the paper 3, with the upstream end being adjacent to the paper feed roller 11 at the bottom, for feeding paper 3 forward, and with the downstream end being adjacent to the subsequently described conveying belt 38, for ejecting the paper 3 rearward.

At the upstream end of the paper feed side U-shaped path 12, the fed paper 3 which has been fed forward is conveyed by the conveying rollers 13 in the paper feed side U-shaped path 12, the conveyance direction is reversed, and after registration by the registration rollers 14, the paper is ejected rearwards by the registration roller 14.

The image forming unit 5 includes process units 17, a transfer unit 18 and a fixation unit 19.

Process units 17 are provided for each toner color. Namely, the process units 17 include four units: a yellow process unit 17Y, magenta process unit 17M, cyan process unit 17C and black process unit 17K. These process units 17 are arranged in parallel one after the other so as to overlap in the horizontal direction, with a space between them, going from front to back.

Each process unit 17 includes a scanner unit 20, serving as an exposure device, fixed to the process unit 17, and a process cartridge 21, mounted removably in the process unit 17.

The scanner unit 20 includes a laser emission unit (not illustrated), polygonal mirror 22, lens 23 and reflecting mirror 24. In the scanner unit 20, laser light emitted from a laser emission unit based on image data is reflected by the polygonal mirror 22, passes through a lens 23, is reflected by the reflecting mirror 24, and is emitted toward the subsequently described photosensitive drum 25.

Each process cartridge 21 is fashioned to be installable and removable in a direction sloping relative to the front-back and up-down directions (the thickness direction of paper 3), i.e. in a direction sloping rearward from the top down (with the upper part sloping forward), and includes a photosensitive drum 25 serving as the photosensitive element, a scorotron type charging device 26, a development roller 27 and a supply roller 28.

The photosensitive drum 25 has a cylindrical shape and includes a drum main body 29 formed from a positive charging photosensitive layer with an outermost layer of polycarbonate or the like, and a drum shaft 30 which extends in the axial direction of the drum main body 29 at the axial center of the drum main body 29. The drum main body 29 is rotatably mounted on the drum shaft 30, and the drum shaft 30 is supported non-rotatably on the two sidewalls in the widthwise direction of the frame of the process cartridge 21 (the direction orthogonal to the front-back and up-down direction; same hereinafter). Then, the photosensitive drum 25 is rotationally driven in the same direction as the direction of travel of the conveying belt 38 (clockwise in the drawing) at the location of contact (the image forming location) with the conveying belt 38, described below.

The scorotron charging device 26 is a positive charging type scorotron charging device which includes a wire and grid and generates a coronal discharge, and is arranged opposite the rear of the photosensitive drum 25, at a gap such that it does not contact the photosensitive drum 25.

The development roller 27 is arranged opposite the photosensitive drum 25 above the photosensitive drum 25, and is pressed against the photosensitive drum 25. This development roller 27 includes a metal roller shaft 31 covered by a roller part 32 made of elastic material such as conductive rubber material. More specifically, the roller part 32 is formed in a two-layer structure comprising an elastic roller unit made of conductive urethane rubber, silicon rubber, EPDM rubber or the like, containing carbon microparticles, etc, and a coating layer which covers the surface of the roller unit and has as its main component urethane rubber, urethane resin, polyimide resin or the like. Furthermore, the roller shaft 31 is rotatably supported on the two widthwise sidewalls of the process cartridge 21.

The supply roller 28 is arranged opposite the development roller 27, above the development roller 27, and is pressed against the development roller 27. This supply roller 28 includes a metal roller shaft 33 coated with roller part 34 including a conductive sponge member. Furthermore, the roller shaft 33 is rotatably supported on the two widthwise sidewalls of the process cartridge 21.

Furthermore, the upper portion of the inside of the process cartridge 21 is formed as a toner holding chamber 35 which holds toner, with toner of each color being held therein. Namely, for each process unit 17, the toner holding chamber 35 holds a positive charging non-magnetic single component polymer toner, having the color yellow for the yellow process unit 17Y, magenta for the magenta process unit 17M, cyan for the cyan process unit 17C and black for the black process unit 17K.

More specifically, for the toner of each color, a substantially spherical polymer toner obtained by the polymerization method is used. Polymer toner has as its main ingredient a binding resin obtained by copolymerizing styrene monomers such as styrene and acrylic monomers such as acrylic acid, alkyl (C1-C4) acrylate and alkyl (C1-C4) methacrylate by known polymerization methods such as suspension polymerization, which is then compounded with coloring agent, charge control agent, wax and the like to form toner core particles, to which external additives are added to improve fluidity.

For the coloring agent, coloring agents of the aforementioned yellow, magenta, cyan and black colors are compounded. Furthermore, for the charge control agent, for example, a charge control resin obtained by copolymerization of an ionic monomer having an ionic functional group, such as an ammonium salt, and a monomer copolymerizable with an ionic monomer, such as styrene monomer or acrylic monomer. Furthermore, for the external additives, for example, silica, aluminum oxide, titanium oxide, strontium titanate, cerium oxide, magnesium oxide or other such metal oxide powders, carbide powders, metal salt powders or other inorganic powders are compounded.

Furthermore, in each process unit 17, during the image forming operation, the toners of each color, housed in the respective toner housing chamber 35, are supplied to the supply roller 28, and are supplied to the development roller 27 by the rotation of this supply roller 28. Here, the toner is positively charged by friction between the supply roller 28 and the development roller 27, to which a development bias is applied.

Furthermore, the scorotron-charging device 26 is made to generate a coronal discharge by applying a charging bias thereto, positively charging the surface of the photosensitive drum 25 in uniform fashion. With the rotation of the photosensitive drum 25, the surface of the photosensitive drum 25 is uniformly positively charged by the scorotron charging device 26 and is then exposed by high speed scanning with laser light from the scanner unit 20, which forms a static latent image corresponding to the image to be formed on the paper 3.

As the photosensitive drum 25 rotates further, the positively charged toner held on the surface of the development roller 27 is brought into contact with the photosensitive drum 25 by the rotation of the development roller 27, whereupon the toner is supplied to the static latent image formed on the surface of the photosensitive drum 25, i.e. to the areas of the uniformly positively charged surface of photosensitive drum 25 which have been exposed to the laser light and have a reduced potential. As a result, the static latent image on the photosensitive drum 25 is rendered visible, and a toner image formed by reverse development comes to be held on the surface of the photosensitive drum 25.

The transfer unit 18 of the main body casing 2 is arranged in the front-back direction above the paper supply unit 4 and below the process units 17, and includes a drive roller 36, follower roller 37, conveying belt 38, transfer roller 39 and belt cleaning device 40.

The drive roller 36 is arranged rearward of the photosensitive drum 25 of the process cartridge 21 installed in the black process unit 17K, at a lower position, which does not overlap the photosensitive drum 25 in the horizontal direction. During image forming, the drive roller 36 is rotationally driven by a motor M2 conceptually illustrated in FIG. 1 (the motor M2 corresponds to the driving means) in a direction (counterclockwise in the drawing) opposite to the direction of rotation of the photosensitive drum 25.

The follower roller 37 is arranged forwards of the photosensitive drum 25 of the process cartridge 21 installed in the yellow process unit 17Y, above the drive roller 36. When rotationally driven by the drive roller 36, the follower roller 37 subordinately rotates in the same direction (counterclockwise in the drawing) as the direction of travel of the conveying belt 38 at the area of contact with the conveying belt 38, described below.

The conveying belt 38 includes an endless belt, and is formed from a resin such as conductive polycarbonate or polyimide, with conductive particles of carbon or the like dispersed therein. The conveying belt 38 is wound between the drive roller 36 and follower roller 37. The driving of the drive roller 36 causes the follower roller 37 to follow, whereby the conveying belt 38 is circulated between the drive roller 36 and follower roller 37 so as to rotate in the same direction as the photosensitive drum 25 at the image forming location facing and contacting the photosensitive drum 25 of each process unit 17. Here, arranging the drive roller 36 downstream and the follower roller 37 upstream with respect to the direction of travel of the conveying belt 38 at the location of contact with the photosensitive drum 25 causes the top part of the conveying belt 38 which faces the photosensitive drum 25 to be pulled as it is conveyed, thus allowing the formation of slack in that part to be prevented. Thus, it becomes possible to precisely convey the paper 3 by the conveying roller 38.

Furthermore, the transfer roller 39 is arranged opposite the photosensitive drum 25 of each process unit 17 across the conveying belt 38 inside the conveying belt 38 that is wound between the drive roller 36 and follower roller 37. This transfer roller 39 includes a metal roller shaft 41 covered by a roller part 42 including an elastic member of conductive rubber material or the like. Furthermore, in the transfer roller 39, both axial ends of the roller shaft 41 are supported rotatably by conductive bearings 43 (FIG. 3).

Figure 6:
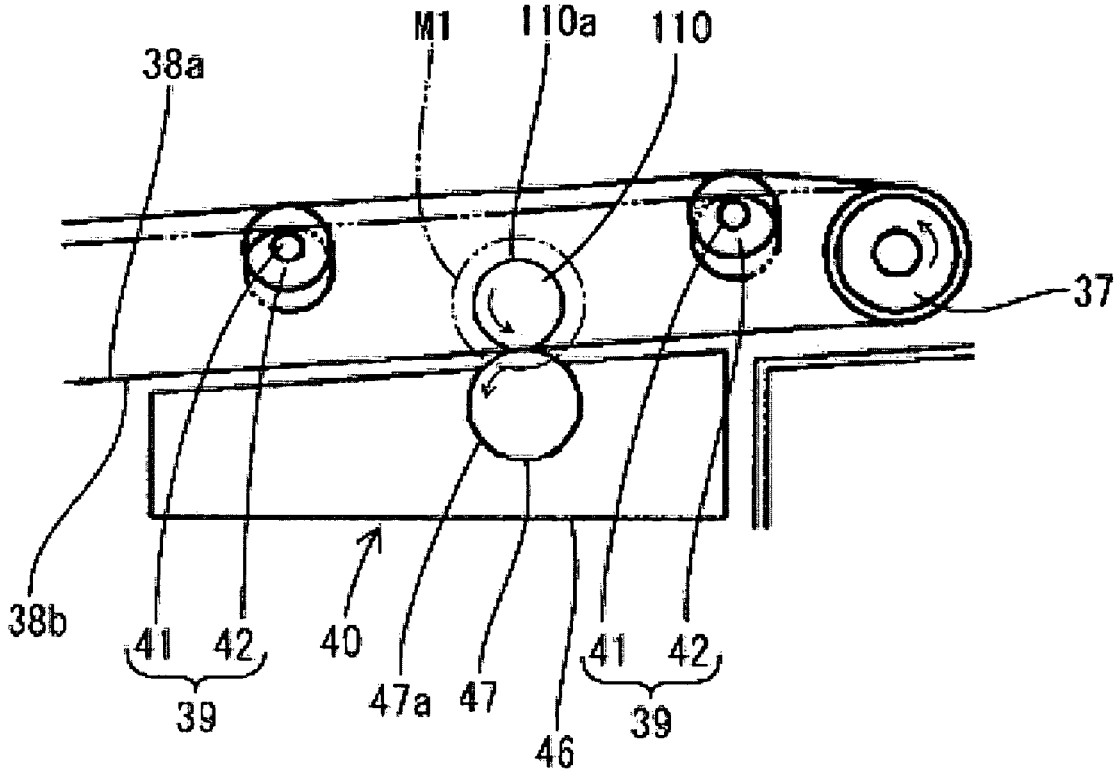
FIG. 6 shows an enlarged illustration of the vicinity of a cleaning device according to at least one aspect of the invention.

Each bearing 43, as shown conceptually in FIG. 3, is supported elastically over a compression spring 44 on a belt unit frame 61 (FIG. 5), described below, with the transfer roller 39 being constantly impelled by the elastic force of the compression spring 44 in a direction so as to press against the photosensitive drum 25. As a result, at the image forming location where the transfer roller 39 and conveying belt 38 face and contact each other, the conveying belt 38 is pushed against the photosensitive drum 25, with a nip being formed between the photosensitive drum 25 and the conveying belt 38. When the belt unit 60 is withdrawn from the main body casing 2, undoing the nip between the photosensitive drum 25 and conveying belt 38, the transfer roller 39 is moved upward by the elastic force of the compression spring 44 and the top part of the conveying belt 38 floats upward. In FIG. 6, the floated position is illustrated by a solid line, and the position before floating is virtually illustrated by a double dotted dashed line.

Furthermore, the compression spring 44 coupled to at least one of the bearings 43 is connected to a transfer bias line 93, and during transfer, a transfer bias is applied to the transfer roller 39 through the transfer bias line 93 via the compression spring 44 and bearing 43. Furthermore, the transfer roller 39 rotates in the same direction (counterclockwise in the drawing) as the direction of circulation of the conveying belt 38 at the image forming location where it faces and contacts the conveying belt 38.

To describe the image forming with reference to FIG. 1, the pieces of paper 3 fed from the paper feed unit 4 are conveyed by the conveying belt 38, which is circulated by the driving of the drive roller 36 and the following of the follower roller 37, from the front rearwards, so as to successively pass through image forming location between the conveying belt 38 and the photosensitive drum 25 of each process unit 17. In the course of this conveyance, the toner images of each color carried on the photosensitive drum 25 of each process unit 17 are successively transferred, whereby a color image is formed on the paper 3.

In other words, for example, once the yellow toner image carried on the surface of the photosensitive drum 25 of the yellow process unit 17Y has been transferred to the paper 3, the magenta toner image carried on the surface of the photosensitive drum 25 of the magenta process unit 17M is transferred in overlapping fashion to the paper 3 over the already transferred yellow toner image, and the cyan toner image carried on the surface of the photosensitive drum 25 of the cyan process unit 17C and the black toner image carried on the surface of the photosensitive drum 25 of the black process unit 17K are transferred in overlapping fashion by the same sort of operation, thus forming a color image on the paper 3.

Since this color laser printer 1 has a tandem device configuration, with process cartridges 21 being provided for each of the colors in each process unit 17, when forming a color image, the toner image of each color is formed at substantially the same speed as the speed of forming a monochrome image, making it possible to achieve rapid forming of a color image. Thus, it becomes possible to form color images while achieving greater miniaturization.

Furthermore, a belt cleaning device 40 is arranged below the conveying belt 38, in a relatively large space formed to the side of the follower roller 37 (a space larger than the space formed to the side of the drive roller 36). This belt cleaning device 40 includes a cleaning box 46 and a cleaning roller 47. The details of the cleaning device 40 are described below.

A fixation unit 19 is arranged rearwards of the transfer unit 18. The fixation unit 19 includes a heating roller 48 and a pressurizing roller 49.

The heating roller 48 includes a metal base pipe with a mold release layer formed on the surface thereof, with halogen lamps housed inside it along its axial direction.

The surface of the heating roller 48 is heated to the fixation temperature by the halogen lamps. Furthermore, the pressurizing roller 49 is arranged so as to press against the heating roller 48.

The color image that has been transferred to the paper 3 undergoes thermal fixation when the paper 3 is conveyed to the fixation unit 19 and passes between the heating roller 48 and the pressurizing roller 49.

The paper ejection unit 6 includes an ejection side U-shaped path 50, paper ejection rollers 51 and a paper ejection tray 52.

The ejection side U-shaped path 50 is formed as a substantially U-shaped conveyance path for the paper 3, with the upstream end thereof being adjacent at the bottom to the fixation unit 19, so that the paper 3 is fed rearwards, and with the downstream end being adjacent at the top to the paper ejection tray 52, so that the paper 3 is ejected forwards.

The paper ejection rollers 51 are provide as a pair of rollers at the downstream end of the paper ejection side U-shaped path 50.

The paper ejection tray 52 is formed on the upper surface of the main body casing 2, as a sloping wall, which slopes downward from the front rearwards.

Paper conveyed from the fixation unit 19 is fed rearwards at the upstream end of the paper ejection side U-shaped path 50, the conveyance direction is reversed in the paper ejection side U-shaped path 50, and the paper is ejected forward onto the paper ejection tray 52 by the paper ejection rollers 51.

Next, the configuration of the belt unit will be described in detail.

In addition to the conveying belt 38 circulated over the drive roller 36 and the follower roller 37 which rotates subordinately thereto, in the color laser printer 1, a belt unit 60, installable and removable horizontally from the front of the main body casing 2, is created by supporting the transfer unit 18, pick-up roller 10, paper feed roller 11, the rear conveying roller 13 and the pair of registration rollers 14 integrally on a belt unit frame 61.

The belt unit 60, as illustrated in FIG. 4, is fashioned so that it can be pulled out through an opening 100 formed in one side surface of the main body casing 2. In the main body casing 2, the drive roller 36 is arranged further to the inside of the opening 100 than the follower roller 37, and with respect to the up-down direction orthogonal to the pull-out direction (the direction of arrow X), the follower roller 37 is arranged closer to the side where the photosensitive drum 25 is provided (i.e. the top side) than the drive roller 36. Based on this sort of configuration, the conveying belt 38 as a whole is arranged sloping from the opening 100 relative to the pull-out direction.

Furthermore, the process cartridges 21 of each color are installed at a location higher than the front process unit 17. Specifically, the installation locations of the process cartridges 21 are set up to become higher by a prescribed amount from the adjacent process unit 17 for the black process unit 17K, cyan process unit 17C, magenta process unit 17M and yellow process unit 17Y, in that order.

As a result, when the process cartridges 21 of each color are installed in the process units 17, the photosensitive drums 25 of process cartridges 21 of each color are arranged such that the line connecting the lower ends of the photosensitive drums 25 in the side of the path where the conveying belt 38 heads from the follower roller toward the drive roller (i.e. in the top side of the path) extends in a sloping direction which lifts the near side in the pull-out direction (the front side) of the subsequently described belt unit 60 upward relative to the horizontal.

Furthermore, arranging the photosensitive drums 25 (process cartridges 21) in this manner causes the space below the image forming unit 5, in which the process units 17 are arranged in parallel, and above the paper tray 9 (the paper feed unit 7, described below) to assume a tapered shape such that the vertical width becomes narrower toward the rear (toward the inside of the main body casing 2) when viewed from the side. This tapered space is the installation space in which the subsequently described belt unit 60 is installed, and in accordance with the tapered shape of this installation space, the overall shape of the belt unit 60 when viewed from the side is tapered such that the vertical width becomes narrower to the inside away from the opening 100 with respect to the pull-out direction.

In the belt unit 60, the upper part of the conveying belt 38 (the part moving from the follower roller toward the drive roller) is arranged to extend along a sloping plane that becomes higher toward the front, and to face and contact the photosensitive drums 25 of the process cartridges 21 installed in the process units 17 from below. In other words, the angle formed at the upper part of the conveying belt 38 between the direction in which the upper part is moved by the drive roller 36 and the horizontal direction, which is the pull-out direction of the belt unit 60, is sloped such that pull-out (withdrawal) of the belt unit 60 undoes the contact between the surface of the conveying belt 38 and the photosensitive drums 25.

The belt unit frame 61, as illustrated in FIG. 5, includes a left side plate 65 and a right side plate 66 arranged opposite each other at a gap in the widthwise direction, a bottom plate 62 installed between the side plates, and a paper guide element 64 (FIG. 1) installed above the front end of the bottom plate 62 so as to be slidable between the left side plate 65 and the right side plate 66, for guiding the paper 3 conveyed along the paper feed side U-shaped path 12 onto the conveying belt 38.

The pick-up roller 10, paper feed roller 11, the rear conveying roller 13, the pair of registration rollers 14, the drive roller 36 and the follower roller 37 are mounted rotatably in this belt unit frame 61 between the left side plate 65 and right side plate 66, as shown in FIG. 1. Furthermore, the transfer roller 39 is rotatably mounted between the left side plate 65 and right side plate 66 by supporting the bearings 43 (FIG. 6) of the two ends of the roller shaft 41 of transfer roller 39 respectively on the left side plate 65 and right side plate 66 illustrated in FIG. 5. Furthermore, a depression 103 deeper than the part in front and to the rear of it is formed in the area of the bottom plate 62 opposite the conveying belt 38 except for the part of it near the follower roller 37, and the belt cleaning device 40 is arranged at the front of the inside of this depression 103.

According aspects of the invention, the conveying belt 38 as a whole slopes such that the near side approaches the image carriers, which makes it possible to simultaneously undo the nip with the photosensitive drums 25 when the conveying belt 38 is pulled out through the opening 100 in the main body casing 2. Furthermore, the belt cleaning device 40 is arranged in the slanted space on the side of the circulating path of the conveying belt 38 where the conveying belt 38 goes from the drive roller side to the follower roller side (i.e. the bottom part of the conveying belt 38), and the location of contact between the cleaning roller 47 and the conveying belt 38 is at the bottom part of the conveying belt 38 closer to the follower roller 37 than to the drive roller 36, providing for an arrangement which makes it possible to achieve greater miniaturization by effectively utilizing the space created by the slant.

Furthermore, the bottom ends of the left side plate 65 and right side plate 66 in the belt unit 60 are bent inwards in the widthwise direction, forming a paper feed unit guide 67 for guiding the movement of the paper feed unit 70 (paper feed unit frame 71) during installation and removal. According to aspects of the invention, the paper tray 9 and the front conveying roller 13 are integrally supported on the paper feed unit frame 71, thereby creating a paper feed unit 70 which can be installed and removed in the main body casing 2 horizontally from the front, and providing an arrangement whereby the paper feed unit 70 is guided by the paper feed unit guide 67. As illustrated in FIG. 5, the paper feed unit frame 71 includes a left side plate 72 and a right side plate 73 arranged facing each other at a gap in the widthwise direction, and a front plate 74 (see FIG. 1) installed between the front ends of the side plates. The paper feed unit frame 71 holds the paper tray 9 behind the front plate 74, sandwiched between the left side plate 72 and right side plate 73.

Furthermore, the left side plate 72 and right side plate 73 are positioned at a prescribed gap opposite the left side plate 65 and the right side plate 66 of the belt unit frame 61 respectively. Furthermore, a protrusion 75 is formed in the left side plate 72 and right side plate 73, protruding from the respective top end outward in the widthwise direction and extending in the front-back direction. The interlocking of the two protrusions 75 from above with the paper feed unit guide 67 of the belt unit frame 61 allows the paper feed unit frame 71 to be supported slidably in the horizontal direction along the paper unit guide 67 with respect to the belt unit frame 61. This arrangement makes it possible to pull out the paper feed unit 70 independently of the belt unit 60, as illustrated in FIG. 2.

Furthermore, the main body casing 2 includes a left main body side plate 81 and a right main body side plate 82 arranged opposite the left side plate 65 and right side plate 66 of the belt unit frame 61 at a prescribed gap in outward in the widthwise direction when the belt unit 60 is installed.

A belt unit guide 83 is formed at the lower ends of the left main body side plate 81 and the right main body side plate 82, protruding inward in the widthwise direction and extending lengthwise in the front-back direction. A guide part 85 is formed in the top end of each belt unit guide 83 by notching the widthwise inner part into a rectangular shape in front view along its entire length. The bottom ends of the left side plate 65 and right side plate 66 of the belt unit frame 61 engage with these guide parts 85, allowing the belt unit frame 61 to be slidably installed in the main body casing 2 horizontally along the guide parts 85 (belt unit guides 83).

Furthermore, as shown in FIG. 1, the main body casing 2 includes an electrode holder 86, arranged opposite the rear side of the belt unit frame 61 when the belt unit frame 61 is installed in the main body casing 2. This electrode holder 86 holds (e.g. six) electrodes 92, lined up in the widthwise direction and extending forward.

As illustrated in FIG. 1, the belt cleaning device 40 is arranged in a relative large space formed below the conveying belt 38 closer to the follower roller 37, and includes a cleaning box 46 and cleaning roller 47. As shown in the enlarged view in FIG. 6, the cleaning box 46 has a box shape, with an opening formed in a portion of the side facing the bottom part of the conveying belt 38 (the part where the conveying belt 38 moves from the drive roller 36 toward the follower roller 37), and with the inner space of the box being formed into a removed material accumulation area which accumulates adhering materials removed from the conveying belt 38.

The cleaning roller 47 is a roller with a metal shaft covered by a cylindrical sponge and is supported rotatably at the opening of the cleaning box 46 and contacts the outer surface 38*b* of the bottom part of the conveying belt 38. This cleaning roller 47 is driven so as to impart a force against the conveying belt 38 in the opposite direction to the direction of travel of the conveying belt 38 at the contact area during the cleaning operation. Namely, the cleaning roller 47 is rotationally driven by a subsequently described motor M1 such that the circumferential surface 47*a* which contacts the conveying belt 38 (the circumferential surface 47*a* corresponds to the contact part) moves in the opposite direction to the direction of travel of the conveying belt 38 at the location of contact with the conveying belt 38. A cleaning bias is impressed onto the cleaning roller 47 through a bias line (not shown).

With this arrangement, adhering materials such as toner adhering to the conveying belt 38 due to contact with the photosensitive drums 25 or paper dust adhering to the conveying belt 38 due to contact with the paper 3 are trapped by the cleaning roller 47 when they are brought opposite the cleaning roller 47 by the movement of conveying belt 38. The trapped adhering materials are then dropped from the cleaning roller 47 in the cleaning box 46 and accumulate in the removed material accumulation area inside the cleaning box 46.

Furthermore, an opposing roller 110 is provided opposite the cleaning roller 47 across the belt 38. This opposing roller 110 is arranged so as to hold the belt between it and the cleaning roller 47. According to aspects of the invention, the opposing roller 110 is configured to rotate so as to impart a motive force to the conveying belt 38.

Specifically, as shown in FIG. 6, the opposing roller 110 is rotationally driven by motor M1 (corresponding to the opposing roller driving means) so that the part which contacts the conveying belt 38 moves in the same direction as the direction of travel of the conveying belt 38 at the contact location. Namely, a force is imparted to the conveying belt 38 by the cleaning roller 47 in a direction opposite to the direction of travel, and a force is imparted by the opposing roller 110 in the same direction as the direction of travel. According to aspects of the invention the motor M1 drives not only the opposing roller 110 but also the cleaning roller 47. Namely, the motor M1 is configured to rotate the opposing roller 110 in the same direction as the direction of rotation of the motor M1, and to rotate the cleaning roller 47 in the direction opposite to the motor M1 by transmitting the driving force via a reverse gear mechanism interlocked with the motor M1 (not shown).

Aspects of the present invention allow the outer surface 38*b* of the conveying belt 38 to be efficiently cleaned by bringing the cleaning roller 47 into contact with the conveying belt 38. In particular, the contact part (circumferential surface 47*a*) of the cleaning roller 47 is configured to move opposite to the direction of travel of the belt, providing for an arrangement, which can clean the conveying belt 38 by acting upon foreign matter on the conveying belt 38. On the other hand, when cleaning is carried out in this manner by bringing the cleaning roller 47 into contact and applying a load to the conveying belt 38, there is the concern of forces being generated against the conveying belt 38 in the direction opposite to the direction of travel due to the contact, creating slack in the conveying belt 38. To address this, according to at least one aspect of the invention, motive force is applied to the conveying belt 38 in the direction of its travel by rotational driving of the opposing roller 110, which is arranged facing the opposite side of the cleaning roller 47 across the conveying belt 38. In other words, tensile force is generated against the conveying belt 38 in the direction of travel, canceling at least part of the force in the opposite direction due to the contact, thereby making it possible to effectively suppress slackening of the conveying belt 38 and thus allowing high precision stable belt driving.

Furthermore, according to aspects of the invention, the frictional coefficient between the opposing roller 110 and the conveying belt 38 is greater than the frictional coefficient between the cleaning roller 47 and the conveying belt 38. In other words, the force exerted by the opposing roller 110 in the direction of travel of the belt is greater than the force in the direction opposite to the direction of travel of the belt exerted by the cleaning roller 47. This arrangement makes it possible to effectively cancel the force applied to the conveying belt 38 by the cleaning roller 47, allowing the conveying belt 38 to be moved more efficiently.

Furthermore, the surface roughness of the inner surface 38*a* of the conveying belt 38 is greater than the surface roughness of the outer surface 38*b*. Moreover, the roughness of surface 110*a* of the opposing roller 110 is greater than the roughness of the surface 47*a* of the cleaning roller 47. This arrangement makes it possible to implement an arrangement whereby the frictional coefficient of the friction generated between the opposing roller 110 and conveying belt 38 is made greater than the frictional coefficient of the friction generated between the cleaning roller 47 and conveying belt 38.

Here, one example of an arrangement for making the frictional coefficient between the opposing roller 110 and the conveying belt 38 greater than the frictional coefficient between the cleaning roller 47 and conveying belt 38 has been presented, which is however merely an illustration, with the arrangement not being limited to the above so long as it is an arrangement which makes the frictional coefficient between the opposing roller 110 and conveying belt 38 greater than the frictional coefficient between the cleaning roller 47 and the conveying belt 38.

In the illustrative aspects shown in FIG. 1, taking the location of transfer PO by the transfer roller 39 in the circulation path of the conveying belt 38 (the most upstream transfer location when transfer locations are arranged in parallel (according to this aspects, the transfer location corresponding to the yellow process unit 17Y)) as a reference point for the flow, the drive roller 36 is arranged downstream of the transfer location PO, and the cleaning roller 47 is provided further downstream of the drive roller 36. With this arrangement, even if slack due to contact between the cleaning roller 47 and the conveying belt 38 should arise, it will be difficult for the effects of the slack to propagate to the transfer location. Thus, the adverse effects of slack on image forming can be more effectively prevented.

Furthermore, according to some aspects of the invention, the paper 3 separates from the conveying belt 38 upstream of the cleaning roller 47 in the circulation path of the conveying belt 38. Therefore, the cleaning roller 47 does not interfere with the conveyed paper 3, making it possible for both image forming on the paper 3 and cleaning of the conveying belt 38 to be implemented well. In other words, if the cleaning roller 47 is upstream of the location where the paper 3 is separated from the conveying belt 38, special measures such as moving the cleaning roller 47 away during paper conveyance will be necessary to avoid destroying the image not affixed to the recording medium, whereas the aspects of the invention render such special measures unnecessary, making it possible to simplify the configuration.

Furthermore, the drive roller 36 and opposing roller 110 are configured to have the same circumferential velocity during actual operation. Namely, the speed of the motor M2 driving the drive roller 36 and the speed of the motor M1 driving the opposing roller 110 are adjusted so that the drive roller 36 and opposing roller 110 will have the same circumferential velocity. This arrangement maintains the travel speed of the belt near the drive roller 36 at substantially the same speed as the travel speed of the belt near the opposing roller 110, thus making it possible to stably convey the conveying belt 38.

Although an example was presented according to aspects of the invention where the motor M2 driving the drive roller 36 and the motor M1 driving the opposing roller 110 are fashioned as separate motors, they can also be the same motor. Namely, an arrangement whereby the driving force from a single motor is distributed to the driving roller 38 and the opposing roller 110 is also acceptable. In this case, instead of the arrangement described above, the drive roller 38, opposing roller 110 and cleaning roller 47 may be driven together by the same motor, or the drive roller 38 and opposing roller 110 may be driven by the same motor and the cleaning roller 47 by a different motor.

Furthermore, although an arrangement whereby cleaning roller 47 is driven by motor M1 which drives the opposing roller 110 (i.e. an arrangement wherein the opposing roller 110 and the cleaning roller 47 are driven by the same motor) was described according to aspects of the invention, the motor driving the opposing roller 110 and the motor driving the cleaning roller 47 may also be separate. In this case, instead of the arrangement described above, the drive roller 38, opposing roller 110 and cleaning roller 47 can all be driven by separate motors.

According to aspects of the invention described above, a so-called color laser printer was illustrated, wherein transfer rollers 39 are provided and each transfer roller 39 transfers developers of different colors. With an arrangement whereby image forming is carried out by transferring developers of different colors, it is necessary to precisely align the developer images of each color, necessitating high precision conveyance. The utility of devices which perform this sort of image forming is increased according to aspects of the present invention, for example, applying an arrangement which prevents belt slackening of the conveying belt 38 and allows high precision belt driving to be carried out.

The present invention is not limited to the aspects explained in the foregoing description and figures. For example, the following aspects are also included within the technical scope of the present invention. Various other modifications besides the following can also be implemented.

(1) The "image forming device" can be not only a printing device such as a printer (e.g. a laser printer), but also a facsimile device or a combination device with a printer function, scanner function and the like. Furthermore, the invention is not limited to a tandem system including an image carrier for each development roller 27 as in the above-described aspects, and can also be a transfer element system, intermediate transfer element system or single pass system, wherein each development roller forms a developer image on a common image carrier.

(2) The recording medium is not limited to paper or a paper-based recording medium, and can also be plastic recording medium such as an OHP sheet.

(3) The belt referred is not limited to a conveying belt as in the above-described illustrative aspects. For example, if the image forming device is fashioned as an image-on-image type (single pass or multiple rotation) device, a "photosensitive element belt" on which static latent images are formed by exposure can be used as the "belt" according to aspects of the present invention. Furthermore, if the image forming device is fashioned as an intermediate transfer element type device, an "intermediate transfer belt", which plays a relaying role until the developer image carried on the photosensitive element is transferred to the recording medium, can be used as the "belt" according to aspects of the present invention.

(4) While the opposing roller 110 was provided as a separate component from the drive roller 36 in the above-described aspects, the invention is not limited to this sort of arrangement. For example, a drive roller, which supports and drives the belt along with the follower roller can be used as the "opposing roller". Examples of this would include the arrangement whereby, instead of the arrangement of FIG. 1, the cleaning device 40 is placed near the drive roller 36. Specific examples would include the arrangement whereby the cleaning roller 47 illustrated in FIG. 1 is arranged facing the drive roller 36 and motive force is applied to the conveying belt 38 while holding it between the cleaning roller 47 and the drive roller 36. However, under this arrangement, there is the risk of slack being created over the circumferential surface of the drive roller, so the above-described aspects may be more effective in preventing slack.

(5) Although in the above aspects, an arrangement was illustrated wherein the cleaning roller rotates in the reverse direction (i.e. an arrangement whereby the direction of movement of the cleaning roller is opposite to the direction of movement of the belt at the contact location), an arrangement wherein it rotates in the forward direction is also possible (i.e. an arrangement whereby the direction of movement of the cleaning roll and the direction of movement of the belt at the contact location is the same). In this case, the travel speed of the belt can be made different from the circumferential velocity of the cleaning roller. Examples include the arrangement where the circumferential velocity of the cleaning roller is made slower than the circumferential velocity of the drive roller. However, the arrangement of the above-described aspects (i.e. the arrangement wherein the direction of movement of the cleaning roller is the reverse of the direction of movement of the belt at the contact location) may scrape off foreign matter better and may have higher cleaning performance.

(6) While a cleaning roller was given as an example of a cleaning member in the above-described aspects, the invention is not limited thereto. For example, a member capable of sweeping off or scraping off foreign matter from the belt (e.g. a cleaning blade fashioned in a blade shape) may also be used.

Although the cleaning member in the above-described aspects was fashioned as a cylindrical cleaning roller, the invention is not limited thereto. For example, the cleaning member may also be fashioned as a rotatable brush member. In this case, the tip of the brush may correspond to the "contact part".

What is claimed is:

1. An image forming device comprising:

a belt configured to engage in circulating movement along a circulation path; a drive roller configured to transmit a driving force to said belt;

a cleaning member configured to contact the belt and clean the belt;

a roller arranged opposite said cleaning member and sandwiching the belt with the cleaning member;

a roller driver configured to cause said roller arranged opposite the cleaning member to rotate so as to impart motive force to said belt; and a transfer device configured to transfer developer to said belt at a transfer position which represents a starting point of the circulation path, wherein said drive roller is provided downstream of the transfer position in the circulation path, and said cleaning member and the roller are provided downstream of said drive roller.

2. The image forming device as set forth in claim 1, wherein said cleaning member comprises a cleaning roller having a contact portion configured to contact said belt, the cleaning roller being driven to move in a direction opposite to a direction of movement of said belt at a location where the contact portion contacts said belt.

3. The image forming device as set forth in claim 1, wherein a circumferential surface of said cleaning roller contacts said belt.

4. The image forming device as set forth in claim 1, wherein the frictional coefficient between said roller arranged opposite the cleaning member and said belt is greater than the frictional coefficient between said cleaning member and said belt.

5. The image forming device as set forth in claim 4, wherein the cleaning member contacts the outer surface of the belt and the roller arranged opposite the cleaning member contacts the inner surface of the belt, the coarseness of the inner surface of said belt being greater than the coarseness of the outer surface of the belt.

6. The image forming device as set forth in claim 4, wherein the coarseness of said cleaning member is greater than the coarseness of said roller.

7. The image forming device as set forth in claim 1, wherein said drive roller and said roller arranged opposite the cleaning member have the same rotational speed.

8. The image forming device as set forth in claim 1, further comprising a plurality of said transfer devices, wherein each transfer device transfers a different color developer.

9. The image forming device as set forth in claim 8, further comprising:

a follower roller over which the belt circulates, the follower roller being positioned downstream from the drive roller;

a plurality of image carriers arranged in parallel, the image carriers opposing the belt at a position upstream of the drive roller; and a housing; and wherein said belt is configured to be pulled out through an opening formed in one side of the housing of the image forming device;

said drive roller is provided in said housing further from said opening than said follower roller;

a first plane passing through a center point of the follower roller in the removal direction is closer to a plane passing through a center point of any one of the image carriers in the removal direction than a second plane passing through a center point of the drive roller in the removal direction; and said cleaning member is arranged upstream of the follower roller.

10. An image forming device comprising:

a belt configured to engage in circulating movement along a circulation path;

a drive roller configured to transmit a driving force to said belt;

a cleaning member configured to contact the belt and clean the belt;

a roller arranged opposite said cleaning member and sandwiching the belt with the cleaning member;

a roller driver configured to cause said roller arranged opposite the cleaning member to rotate so as to impart motive force to said belt; and a transfer device configured to transfer developer to a recording medium on said belt at a transfer position which represents a starting point of the circulation path, wherein said drive roller is provided downstream of the transfer position in the circulation path, and said cleaning member is provided downstream of said drive roller.

11. The image forming device as set forth in claim 10, wherein said belt is configured to convey said recording medium, and is configured to separate from said recording medium upstream of said cleaning member in the circulation path of said belt.

12. The image forming device as set forth in claim 11, wherein said drive roller and said roller arranged opposite the cleaning member have the same rotational speed.

13. The image forming device as set forth in claim 10, further comprising a plurality of said transfer devices, wherein each transfer device transfers a different color developer.

14. The image forming device as set forth in claim 13, further comprising:

a follower roller over which the belt circulates, the follower roller being positioned downstream from the drive roller;

a plurality of image carriers arranged in parallel, the image carriers opposing the belt at a position upstream of the drive roller; and a housing; and wherein said belt is configured to be pulled out through an opening formed in one side of the housing of the image forming device;

said drive roller is provided in said housing further from said opening than said follower roller;

a first plane passing through a center point of the follower roller in the removal direction is closer to a plane passing through a center point of any one of the image carriers in the removal direction than a second plane passing through a center point of the drive roller in the removal direction; and said cleaning member is arranged upstream of the follower roller.

15. An image forming device comprising:

a drive roller;

a follower roller;

a belt wound around the drive roller and the follower roller and configured to engage in circulating movement in a first direction along a circulation path;

at least one transfer device configured to transfer developer to a recording medium on the belt at a transfer position;

a cleaning member which rotates in a direction opposite to the first direction of movement of said belt at a location where the cleaning member contacts said belt, and is configured to contact the belt and clean the belt;

a roller different from the drive roller arranged opposite the cleaning member and sandwiching the belt with the cleaning member; and a roller driver configured to cause the roller arranged opposite the cleaning member to rotate so as to impart motive force to the belt, wherein, with respect to the circulating movement of the belt in the first direction from the transfer position, the drive roller is arranged downstream of the transfer position and the follower roller is arranged further downstream from the transfer position than the drive rollers, wherein the drive is a first roller along the circulation path downstream of the transfer position.

16. The image forming device as set forth in claim 15, wherein the cleaning member and the roller arranged opposite the cleaning member are positioned between the drive roller and the follower roller.

17. The image forming device as set forth in claim 15, further comprising a plurality of the transfer devices, wherein each transfer device transfers a different color developer.

18. An image forming device comprising:

a drive roller;

a follower roller;

a belt wound around the drive roller and the follower roller and configured to engage in circulating movement in a first direction along a circulation path;

at least one transfer device configured to transfer developer to a recording medium on the belt at a transfer position;

a cleaning member which rotates in a direction opposite to the first direction of movement of said belt at a location where the cleaning member contacts said belt, and is configured to contact the belt and clean the belt;

a roller different from the drive roller arranged opposite the cleaning member and sandwiching the belt with the cleaning member; and a roller driver configured to cause the roller arranged opposite the cleaning member to rotate so as to impart motive force to the belt, wherein, with respect to the circulating movement of the belt in the first direction from the transfer position, the drive roller is arranged downstream of the transfer position and the follower roller is arranged further downstream from the transfer position than the drive roller, further comprising a plurality of the transfer devices, wherein each transfer device transfers a different color developer, wherein at least one of the transfer devices has a transfer position which represents a starting point of the circulation path, wherein the drive roller is provided downstream of the transfer position in the circulation path, and the cleaning member is provided downstream of the drive roller.

19. The image forming device as set forth in claim 18, wherein the belt is configured to convey the recording medium, and is configured to separate from the recording medium upstream of the cleaning member in the circulation path of the belt.

* * * * *

UNITED STATES PATENT AND TRADEMARK OFFICE

CERTIFICATE OF CORRECTION

PATENT NO. : 7,606,510 B2
APPLICATION NO. : 11/391252
DATED : October 20, 2009
INVENTOR(S) : Naoya Kamimura It is certified that error appears in the above-identified patent and that said Letters Patent is hereby corrected as shown below:

In Column 15, Claim 15, Line 30:
Please replace "drive is a" with --drive roller is a--

Signed and Sealed this

Ninth Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,606,510 B2
APPLICATION NO. : 11/391252
DATED : October 20, 2009
INVENTOR(S) : Naoya Kamimura It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 684 days.

Signed and Sealed this

Twelfth Day of October, 2010

David J. Kappos

David J. Kappos
*Director of the United States Patent and Trademark Office*